US009416632B2

(12) United States Patent
Vu et al.

(10) Patent No.: US 9,416,632 B2
(45) Date of Patent: Aug. 16, 2016

(54) CONTAINMENT SYSTEM

(71) Applicant: TOTAL SA, Courbevoie (FR)

(72) Inventors: Van-Khoi Vu, Paris (FR); Jean-Claude Bourguignon, Pau (FR); Hubert Rossano, Pau (FR); Guillaume Vaillant, Pau (FR)

(73) Assignee: Total SA, Courbevoie (FR)

( * ) Notice: Subject to any disclaimer, the term of this patent is extended or adjusted under 35 U.S.C. 154(b) by 0 days.

(21) Appl. No.: 14/425,622

(22) PCT Filed: Sep. 9, 2013

(86) PCT No.: PCT/EP2013/068640

§ 371 (c)(1),
(2) Date: Mar. 3, 2015

(87) PCT Pub. No.: WO2014/037567

PCT Pub. Date: Mar. 13, 2014

(65) Prior Publication Data

US 2015/0240604 A1 Aug. 27, 2015

Related U.S. Application Data

(60) Provisional application No. 61/698,250, filed on Sep. 7, 2012.

(51) Int. Cl.
*E02B 15/04* (2006.01)
*E21B 43/01* (2006.01)
(Continued)

(52) U.S. Cl.
CPC ..... *E21B 43/0122* (2013.01); *E02B 15/04* (2013.01); *E02B 15/046* (2013.01); *E21B 43/2401* (2013.01); *E21B 43/36* (2013.01); *E02B 2015/005* (2013.01); *Y10S 210/922* (2013.01)

(58) Field of Classification Search
CPC ..... E21B 43/0122; E02B 2015/005; E02B 15/00; E02B 15/04; E02B 15/045; E02B 15/046
USPC ..... 405/60, 64
See application file for complete search history.

(56) References Cited

U.S. PATENT DOCUMENTS 3,643,741 A 2/1972 Miranda
3,667,605 A 6/1972 Zielinski
(Continued)

FOREIGN PATENT DOCUMENTS

FR 2804935 A1 * 8/2001 ..... B63C 7/006
FR 2961843 12/2011
(Continued)

OTHER PUBLICATIONS

International Search Report and Written Opinion of the International Searching Authority for PCT/EP2013/068640, mailed May 22, 2014, 10 Pgs.
(Continued)

*Primary Examiner* — Frederick L Lagman
(74) *Attorney, Agent, or Firm* — Patterson Thuente Pedersen, P.A.

(57) ABSTRACT

A containment system for recovering hydrocarbon fluid from a leaking device situated at a deep seafloor comprising a pipe for conveying an input fluid that is a mix of water, oil, gas, and hydrate, and a treatment facility fed with the input fluid from the pipe and separating the components of the input fluid. The treatment facility comprises a tank for dissociation of hydrate component and extraction of the oil component. The treatment facility comprises a heater device inside the tank.

8 Claims, 2 Drawing Sheets

(51) Int. Cl.

| | |
|---|---|
| ***E21B 43/24*** | (2006.01) |
| ***E21B 43/36*** | (2006.01) |
| *E02B 15/00* | (2006.01) |

(56) References Cited

U.S. PATENT DOCUMENTS

| | | | | |
|---|---|---|---|---|
| 3,762,548 | A * | 10/1973 | McCabe | B01D 17/0208 210/170.11 |
| 4,395,157 | A | 7/1983 | Cunningham | |
| 4,531,860 | A | 7/1985 | Barnett | |
| 5,213,444 | A | 5/1993 | Henning | |
| 8,025,103 | B1 * | 9/2011 | Wolinsky | E21B 43/0122 166/356 |
| 2006/0283590 | A1 | 12/2006 | Poldervaart et al. | |
| 2011/0274493 | A1 | 11/2011 | Cutts | |
| 2011/0293372 | A1 | 12/2011 | Later | |
| 2011/0299929 | A1 | 12/2011 | Sabourin | |
| 2011/0315233 | A1 | 12/2011 | Carter | |
| 2011/0315393 | A1 * | 12/2011 | Wolinsky | E21B 43/0122 166/363 |
| 2011/0315396 | A1 * | 12/2011 | Wolinsky | E21B 43/0122 166/363 |
| 2012/0024533 | A1 | 2/2012 | Ivic | |
| 2012/0051840 | A1 | 3/2012 | Hatton | |
| 2012/0073823 | A1 * | 3/2012 | McClanahan | B01D 19/0073 166/344 |
| 2012/0087729 | A1 | 4/2012 | Oesterberg | |
| 2012/0118580 | A1 | 5/2012 | Swanson | |
| 2012/0125623 | A1 | 5/2012 | Cargol, Jr. et al. | |
| 2012/0155964 | A1 | 6/2012 | Carter et al. | |
| 2012/0181041 | A1 | 7/2012 | Willman | |
| 2012/0186822 | A1 | 7/2012 | Mahajan | |
| 2012/0213588 | A1 | 8/2012 | Shifferaw | |
| 2012/0247781 | A1 | 10/2012 | Noble et al. | |
| 2012/0251244 | A1 | 10/2012 | Toedtman | |
| 2013/0046126 | A1 | 2/2013 | Varney et al. | |
| 2013/0074757 | A1 | 3/2013 | McAlister | |
| 2013/0118754 | A1 | 5/2013 | Worrall et al. | |
| 2013/0177356 | A1 | 7/2013 | Edmondson | |
| 2013/0183098 | A1 | 7/2013 | Halal et al. | |
| 2013/0270194 | A1 | 10/2013 | Allen | |
| 2014/0356068 | A1 | 12/2014 | Andritsos et al. | |

FOREIGN PATENT DOCUMENTS

| | | | |
|---|---|---|---|
| FR | 2972216 | | 9/2012 |
| GB | 2480112 | A | 11/2011 |
| WO | WO 2011/154733 | A1 | 12/2011 |
| WO | WO 2011/163239 | A1 | 12/2011 |
| WO | WO 2011/163573 | A2 | 12/2011 |
| WO | WO 2012/050823 | A2 | 4/2012 |

OTHER PUBLICATIONS

International Application No. PCT/EP2013/068644, filed Sep. 9, 2013,International Search report, mailed May 9, 2014, 3 pages.

International Application No. PCT/EP2013/065359, filed Jul. 19, 2013, International Search report, mailed May 14, 2014, 3 pages.

Application and File History for U.S. Appl. No. 14/426,244, filed Mar. 5, 2015, Inventors: Vu et al.

Application and File History for U.S. Appl. No. 14/426,287, filed Mar. 5, 2015, Inventors: Vu et al.

* cited by examiner

CONTAINMENT SYSTEM

RELATED APPLICATIONS

The present application is a National Phase entry of PCT Application No. PCT/EP2013/068640, filed Sep. 9, 2013, which claims priority from U.S. Patent Application No. 61/698,250 filed Sep. 7, 2012, said applications being hereby incorporated by reference herein in their entirety.

FIELD OF THE INVENTION

The present invention concerns a containment system for recovering spilled oil that is leaking under water.

BACKGROUND OF THE INVENTION

The present invention concerns more precisely a containment system for recovering a hydrocarbon fluid from a leaking device that is situated at the seafloor and that is leaking the hydrocarbon fluid from a well.

Recovering oil that is leaking from an under water oil device is a great problem, especially for oil device that are installed at deep sea floor.

The explosion on the "Deepwater Horizon" platform in the Gulf of Mexico demonstrated how much such a containment system is difficult to control.

One of the main problems was the formation of hydrates that clogged the used containment system.

For example, at a depth of around 1500 meters, the sea water is cold (for example around only 5° C.) and at a high pressure. These environment conditions may transform the sea water and hydrocarbon fluid into hydrates having a quasi-solid phase and which can fill and clogged any cavity.

Hydrates inhibitors like methanol could be injected to avoid hydrate formation. But, the needed quantity of such chemical is huge and inhibitors are also pollution for the environment.

The document US 2011/315233 discloses a containment system that comprises:

a pipe (main conduit) having a lower end positioned above and substantially near the leaking device and an upper end positioned substantially near the sea surface, said pipe conveying a input fluid that is a mix of components, said components comprising at least water, oil, gas, and hydrate, a treatment facility (tank) fed with the input fluid from the pipe and separating the components of the input fluid.

However, the treatment facility of such containment system is a huge containment tank situated bellow the sea surface. Such tank is difficultly feasible.

Moreover, the flow of input fluid is so big that such simple gravity separator is inefficient.

Hydrates inside such containment system will accumulate inside the tank, and can not dissociate by themselves.

SUMMARY OF THE INVENTION

One object of the present invention is to provide a containment system that is improved.

To this effect, the containment system of present invention is characterised in that:

the pipe has a diameter adapted to convey the hydrate from the lower end to the upper end, and the treatment facility comprises a tank connected to the pipe for receiving the input fluid, adapted for dissociation of hydrate component and adapted for providing an output fluid having a concentration in oil higher than the concentration in oil of the input fluid, and the treatment facility comprises a heater device inside the tank for heating the input fluid.

Thanks to these features, the hydrate component is dissociated inside the tank into a gas and water. The gas migrates to the top of the tank. The water migrates to the bottom of the tank and mixes to the water component contained inside the input fluid and coming from the sea water sucked from sea by the pipe together with the hydrocarbon fluid outputted from the leaking device.

In various embodiments of the containment system, one and/or other of the following features may optionally be incorporated.

According to an aspect of the containment system, the diameter of the pipe is larger than 50 cm, and preferably larger than 1 m.

According to an aspect of the containment system, the pipe comprises a plurality of holes between the lower end and the upper end.

According to an aspect of the containment system, wherein the heater device is a heat exchanger.

According to an aspect of the containment system, the heat exchanger uses sea water near the sea surface as a primary fluid.

According to an aspect of the containment system, the tank comprises a first cavity receiving the input fluid from the pipe, a second cavity for separating liquid components of the input fluid, and a third cavity for extracting an output fluid, and wherein:

a first wall separates the first cavity and the second cavity said first wall comprising a plurality of lateral holes to allow transfer of input fluid to the second cavity and to cancel flow turbulences, and a second wall separates the second cavity and the third cavity, said second wall having an intermediate opening for transferring oil component to the third cavity.

According to an aspect of the containment system, it further comprises an output separator receiving the output fluid from the tank, the output separator comprising an output heater that heats the output fluid to a temperature higher than 35° C. for separating remaining gas and water from the output fluid.

According to an aspect of the containment system, the output heater is an oil burner or gas burner or a hot heating medium heater or an electric heater.

According to an aspect of the containment system, it further comprises a dome having an upper output opening connected to the lower end of the pipe, said dome forming a cavity adapted to accumulate hydrocarbon fluid coming upwardly from the leaking device for recovering said hydrocarbon fluid.

BRIEF DESCRIPTION OF THE DRAWINGS

Other features and advantages of the invention will be apparent from the following detailed description of at least one of its embodiments given by way of non-limiting example, with reference to the accompanying drawings. In the drawings.

DETAILED DESCRIPTION OF THE DRAWINGS

In the various figures, the same reference numbers indicate identical or similar elements. The direction Z is a vertical direction. A direction X or Y is a horizontal or lateral direction. These are indications for the understanding of the invention.

Figure 1:
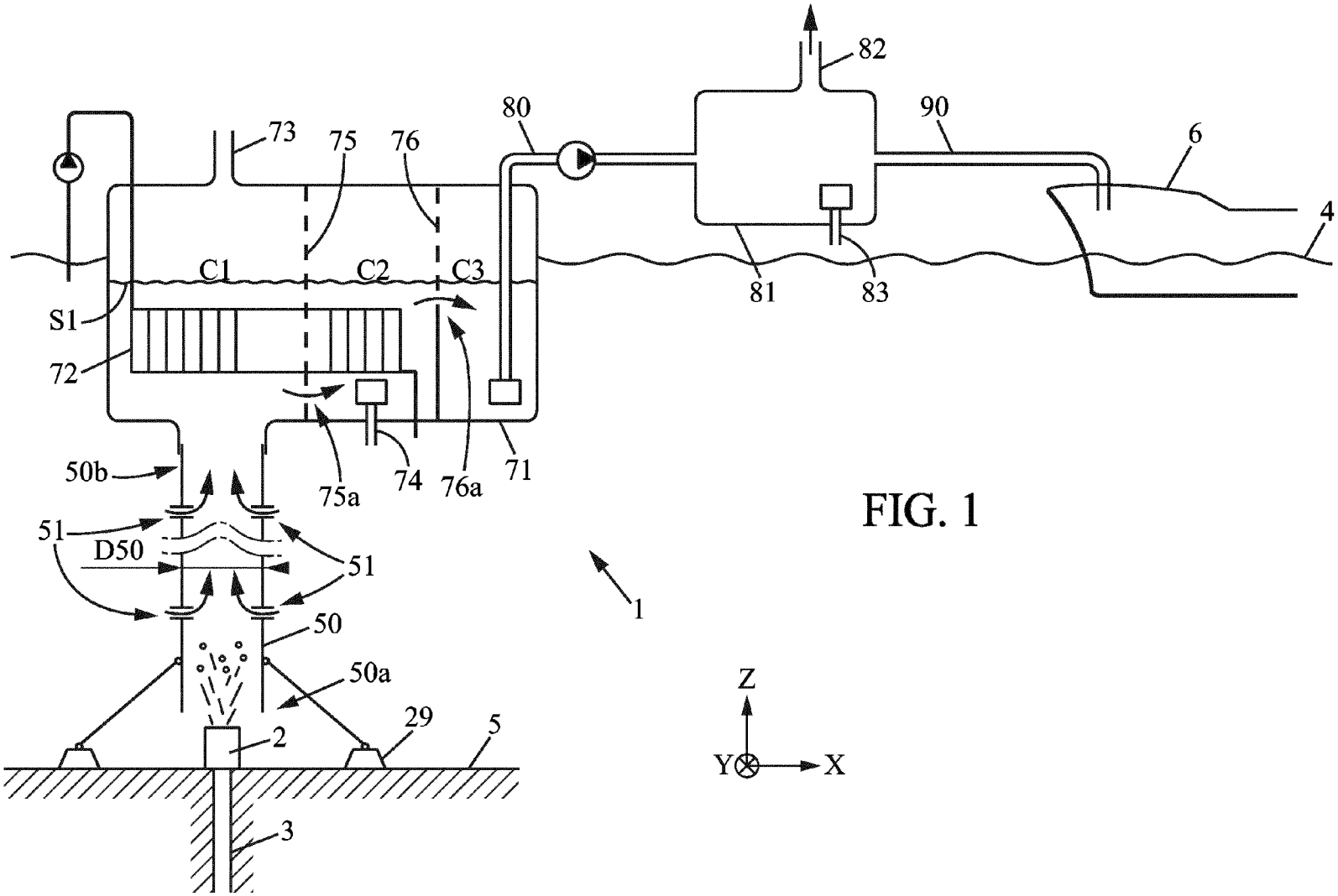
FIG. 1 is a schematic view of a vertical cut of containment system according to a first embodiment of the invention.

As shown on FIG. 1, a containment system 1 according to present invention is adapted for recovering hydrocarbon fluid from a leaking device 2 that is situated at a seafloor 5 of a deep offshore installation. The leaking device 2 is for example the well itself, a pipeline, a blow out preventer device, a wellhead or any device connected to the wellhead. The seafloor 5 is for example at more than 1500 meters deep below the sea surface 4. At this depth, the sea water is cold, for example around only 5° C. and at high pressure.

The hydrocarbon fluid may be liquid oil, natural gas, or a mix of them.

The leaking device 2 is leaking a hydrocarbon fluid from a subsea well 3. The hydrocarbon fluid exiting from the subsea may be rather hot, for example above 50° C. However, the environment cold temperature and high pressure may transform a quantity of sea water and hydrocarbon fluid into hydrates having a quasi-solid or solid phase. These hydrates can fill and clog any small cavity or pipe.

The containment system 1 of present invention can be fixed to the seafloor by any means, such as anchoring or heavy weights 29 for stability of the containment system 1.

The containment system 1 of present invention comprises at least:

a pipe 50 having a lower end 50*a* positioned above and substantially near the leaking device 2 and an upper end 50*b* positioned substantially near the sea surface 5, said pipe conveying an input fluid from the lower end to the upper end, and a treatment facility 70 fed with the input fluid from the pipe 50 and separating the components of the input fluid.

The input fluid is a mix of components: sea water that is sucked by the pipe, hydrocarbon fluid (oil, gas), and hydrates that are formed at the output of the leaking device.

The pipe 50 has a diameter adapted for conveying the hydrate component from the lower 50*a* end to the upper end 50*b* of the pipe without clogging the pipe. Therefore, the diameter of the pipe is preferably enough wide.

For example, the diameter is higher than 50 cm, and preferably higher than 1 m. In use, the diameter is lower than 3 m for the ease of installation.

The pipe 50 may be rigid or flexible.

In case of a rigid pipe, it may be made of any kind of steel or polymer material.

In case of flexible pipe, it may be made of polymer or rubber material. It may also include reinforcing fibbers or fabric as it well known.

The pipe 50 may comprise a plurality of holes 51 situated between the lower end 50*a* and upper end 50*b* of said pipe 50. These holes may be regularly spaced along the pipe.

An added quantity of sea water is sucked by these holes inside the pipe 50. The hydrocarbon fluid from the leaking device 2 is therefore guided and transported by the pipe and the sea water to the upper end 50*b*.

Thanks to these holes, the pipe 50 does not suffer from differential pressure, and will not collapse. The pipe 50 can be more easily a flexible pipe, or a rigid pipe having a lower thickness.

The treatment facility 70 comprises a tank 71. A tank is a large structure having an inner cavity, said tank being adapted to be filled with a fluid. The fluid is contained hermetically inside the inner cavity.

The tank 71 is connected to the upper end 50*b* of the pipe for receiving the input fluid from it. The tank 71 is adapted for dissociation of the solid hydrate component into gas and water, and for providing an output fluid, the output fluid having a concentration in oil higher than the concentration in oil of the input fluid from the pipe 50.

The treatment facility 70 is separating the components of the input fluid by gravity effect: the components with lower densities are accumulated upwards (positive Z direction) inside the treatment facility 70 (tank), whereas the components with higher densities are accumulated downwards (negative Z direction) inside the treatment facility 70.

In case of the considered input fluid, the component will tend to sort inside the treatment facility in the following order according to the Z direction (from bottom to top): water, hydrates, oil and gas.

The tank 71 may be built according to the following arrangements: It is divided into three adjacent cavities (or compartments): a first cavity C1, a second cavity C2 and a third cavity C3. A first wall 75 inside the tank 71 is the limit between the first and second cavity. A second wall 76 inside the tank 71 is the limit between the second and third cavity.

Both first and second walls 75, 76 comprise upper openings so as the gas component may be accumulated inside the upper portion of the three cavities of the tank 71. A gas output 73 may control the extraction of gas from the tank 71. A gas compressing facility may be provided for compressing the gas and reduce its volume (for example by liquefaction). Otherwise, the gas output 73 may be connected to a gas disposal device. an optional gas compressing facility may be provided for compressing the gas and reduce its volume (for example by liquefaction).

A surface S1 may delimit the interface between the gas component inside the tank and the other components.

The first wall 75 comprises openings along its entire height so as all the components in the input fluid are transferred from the first cavity C1 to the second cavity C2. The first cavity C1 is an input cavity for the input fluid. The flow of input fluid is stabilised inside the first cavity, and turbulences coming from the input fluid do not interfere with the fluid contained inside the second cavity C2. The fluid in the cavity C2 can separate its components according to each component density.

The second cavity C2 contains the following components from the bottom to the top: water, hydrates, oil, and gas.

The second wall 76 comprises an intermediate opening 76*a* situated below the surface S1 and near said surface S1 so as the lighter liquid component (oil) is mainly transferred from the second cavity C2 to the third cavity C3 (i.e. oil). The height of the intermediate opening 76*a* may be predetermined or adapted to the flow of input fluid. In last case, the second wall 76 comprises means to modify the position of the intermediate opening 76*a* according to the vertical direction Z.

The lower portion of the third cavity C3 therefore mainly contains the oil component (the output fluid) that can be transferred to a boat 6 via a transfer pipe and pump 80. The output fluid is a fluid having a concentration in oil that is higher than the concentration in oil of the input fluid from the pipe 50.

At the bottom of the second cavity C2, the water component can be extracted by a water output 74. The extracted water may be outputted to the sea if the quality (oil content) is acceptable. Otherwise, a treatment step is necessary before disposal to the sea.

The first and second cavity C1, C2 may includes a heater device 72 that heats the liquid components of the input fluid. The heater device 72 is positioned inside the tank 71 bellow the surface S1 (bellow the predetermined interface level).

Heating the input fluid accelerates the hydrates dissociation and the separation of all the components in the input fluid.

The heater device 72 is preferably a heat exchanger immerged inside the liquid components of the tank 71 (bellow the surface S1). It may comprise a first part inside the first cavity C1 and a second part inside the second cavity C2. It is for example composed of a circuit of tubes canalising a hot primary fluid (heating fluid medium) inside the tank 71, the input fluid being the secondary fluid that must be heated. It is also for example composed of large plates for exchanging heat between the heat exchanger and the input fluid. The heater device 72 is very large. It occupies lots of space inside the first and second cavity. Even if pressure and temperature conditions are adequate, hydrates can not dissociate into gas and water without heating as this dissociation is an endothermic reaction.

The heater device 72 may use sea water near the sea surface 4 a relatively hot primary fluid (between 15° C. and 25° C.) to dissociate hydrates into gas and water at atmospheric pressure. The sea water at sea surface is an inexpensive source of heat for hydrates dissociation at atmospheric pressure.

The treatment facility 70 may preferably comprise an output separator 81 connected to the transfer pipe 80, and therefore fed with the output fluid from the tank 71.

This output separator 81 comprises an output heater that heats the output fluid to a temperature higher than 30° C., so as remaining gas and water contained inside the output fluid can be evacuated. For example, remained gas is extracted via a gas output 82, and remained water is extracted via a water output 83.

The output heater is for example an oil burner or a gas burner or a hot heating medium heater or an electric heater.

A quantity of gas or oil (output fluid) extracted by the tank 71 may be used by the output heater for heating the output heater and the output fluid.

The recovering fluid (degassed and dehydrated) can be then transferred to a boat 6 via a transfer pipe 90. The recovering fluid is a fluid having a concentration in oil that is higher than the concentration in oil of the output fluid in the transfer pipe 80.

The containment system 1 of present invention operates as follows.

The pipe 50 is sucking the hydrocarbon fluid leaking from the leaking device 2. This fluid is going up to the treatment facility 70 by gravity effect and differential pressure effect. The pipe 50 is sucking a huge quantity of cold sea water, the hydrocarbon fluid and the hydrates that are formed at the sea depth. The sea water may represent more than 95% of the volume of fluid transported inside the pipe 50. There is no clogging problem. Only a difficulty of separating the huge quantity of input fluid in the tank at the flow rate as the leaking device 2 may leak up to 100,000 barrels per day.

The dissociation of hydrates is an endothermic reaction. The hydrates can not be dissociated inside the pipe, nor inside the tank 71 without the heating from the heater device 72. The heater device 72 situated inside the tank 71 allows an efficient dissociation of hydrates.

Hydrates are dissociated inside the first and second cavity C1, C2 of the tank 71. The upper portion of the tank 71 recovers the light gas component. The third cavity C3 recovers the light liquid component: the oil component. The water component is extracted back to see at the lower portion of the second cavity C2.

Figure 2:
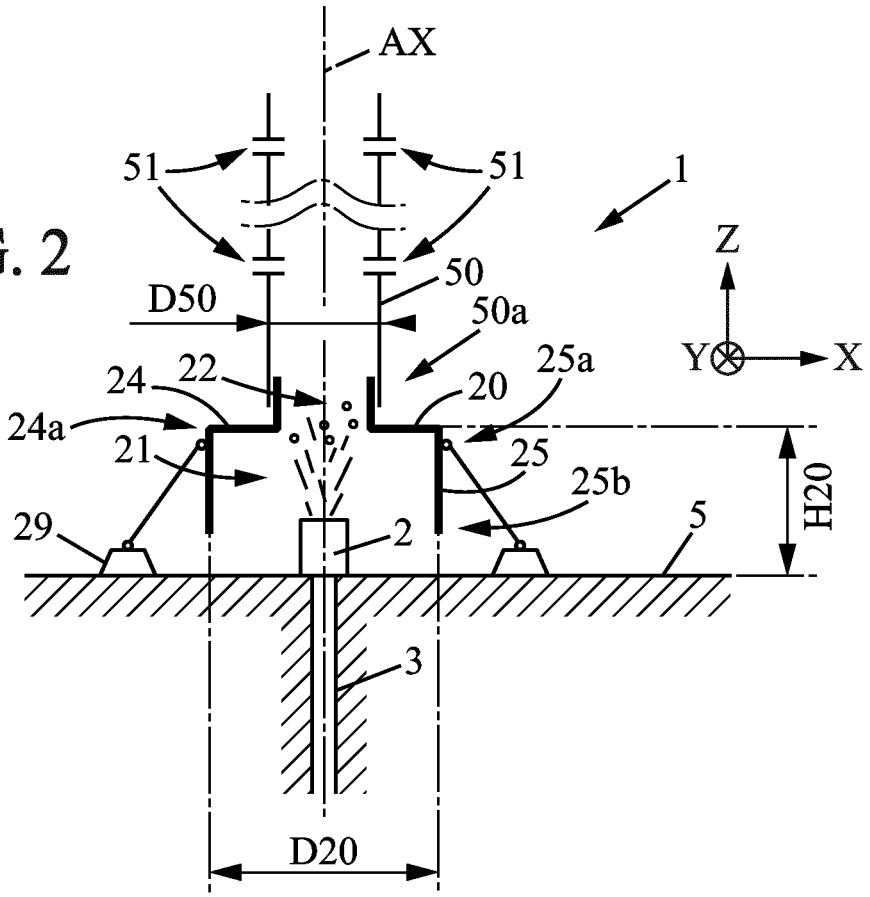
FIG. 2 is a schematic view of a vertical cut of containment system according to a second embodiment of the invention, said view showing only a lower portion of the system, all the other parts being identical to the first embodiment.

In FIG. 2, a second embodiment is shown. In this embodiment, the containment system 1 further comprises a dome 20 under the lower end 50*a* of the pipe 50.

The dome 20 comprises an upper output opening 22 connected to the lower end of the pipe to extract an input fluid comprising the hydrocarbon fluid for recovering and, unfortunately, a quantity of sea water and hydrates.

The dome 20 is preferably fixed to the seafloor.

For example, the dome 20 comprises foot 20*c* having heavy weights for maintaining and securing the dome 20 to the seafloor.

The dome 20 completely surrounds the leaking device 2. In a horizontal plane (XY), the dome 20 has a closed loop shape encompassing the leaking device 2. Said shape may be for example a circle shape, a square shape or any polygonal shape.

The dome 20 has an diameter D20. This outer diameter corresponds to a maximum distance between two internal points of the dome, taken in a horizontal plane. The diameter D20 is for example of 6 meters or more. The typical size of a wellhead (a wellhead that might be included inside the cavity of the dome in case of accident) are for example: a length between 5 and 7 m, a width between 4 and 6 m, and a height between 5 and 7 m.

The dome 20 may be higher than a total height of the leaking device 2. It has a height H20 of approximately 3 meters or more. It completely includes the leaking device 2.

The dome 20 defines an inner dome volume, called the cavity 21.

The dome 20 is a hollow structure having:

an upper portion 24 extending in a radial direction to an outer peripheral end 24*a*, said radial direction being perpendicular to the vertical direction AX (equal to direction Z on the figure), and a lateral portion 25 extending from the upper portion 24 downwardly between an upper end 25*a* and a lower end 25*b*, said lower end 25*b* comprising for example the foot 20*c*.

The lateral portion 25 has said diameter D20.

The lateral portion 25 of the dome is downwardly opened so as to surround the leaking device 2.

The upper output opening 22 having a small diameter compared to the dome diameter. Said upper output opening is connected to the pipe 50 by any means for extracting the hydrocarbon fluid. Advantageously, fast and automatic and self centering means are used. The dome 20 can be installed on the seafloor 5 before the installation of the pipe 50.

In a vertical plane (XZ), the upper portion 24 of the dome 20 may have a convergent shape from the lateral portion 25 up to the upper output opening 22. The dome 20 is a cover that can have advantageously an inverted funnel shape.

The hollow structure of the dome 20 forms a largely opened cavity 21 in the direction to the seafloor. It is positioned above and around the leaking device 2 so as to accumulate the light hydrocarbon fluid.

The cavity 21 accumulates hydrocarbon fluid coming upwardly from the leaking device 2, i.e. oil and/or natural gas. The hydrocarbon fluid fills the upper volume of the cavity, down to an interface level in relation to a base level of the seafloor 5.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A containment system for recovering hydrocarbon fluid from a leaking device that is situated at the seafloor and that is leaking hydrocarbon fluid from a well, and wherein the containment system comprises:

a pipe having a lower end positioned above and substantially near the leaking device and an upper end positioned substantially near the sea surface, said pipe conveying an input fluid that is a mix of components, said components comprising at least water, oil, gas, and hydrate, a treatment facility fed with the input fluid from the pipe and separating the components of the input fluid, the pipe has a diameter adapted to convey the hydrate from the lower end to the upper end, and the treatment facility comprises a tank connected to the pipe for receiving the input fluid, adapted for dissociation of hydrate component and adapted for providing an output fluid having a concentration in oil higher than the concentration in oil of the input fluid, and the treatment facility comprises a heater device inside the tank for heating the input fluid, and wherein the tank comprises a first cavity receiving the input fluid from the pipe, a second cavity for separating liquid components of the input fluid, and a third cavity for extracting an output fluid, and wherein a first wall separates the first cavity and the second cavity, said first wall comprising a plurality of lateral holes to allow transfer of input fluid to the second cavity and to cancel flow turbulences, and a second wall separates the second cavity and the third cavity, said second wall having an intermediate opening for transferring oil component to the third cavity.

2. The containment system according to claim 1, wherein the diameter of the pipe is larger than 50 cm, and preferably larger than 1 m.

3. The containment system according to claim 1, wherein the pipe comprises a plurality of holes between the lower end and the upper end.

4. The containment system according to claim 1, wherein the heater device is a heat exchanger.

5. The containment system according to claim 4, wherein the heat exchanger uses sea water near the sea surface as a primary fluid.

6. The containment system according to claim 1, further comprising an output separator for receiving the output fluid from the tank, said output separator comprising an output heater that heats the output fluid to a temperature higher than 35° C. for separating the remaining gas and water from the output fluid.

7. The containment system according to claim 6, wherein the output heater is an oil burner or gas burner or a hot heating medium heater or an electric heater.

8. The containment system according to claim 1, further comprising a dome having an upper output opening connected to the lower end of the pipe, said dome forming a cavity adapted to accumulate hydrocarbon fluid coming upwardly from the leaking device for recovering said hydrocarbon fluid.

* * * * *